US009250569B2

(12) United States Patent
Morita

(10) Patent No.: US 9,250,569 B2
(45) Date of Patent: Feb. 2, 2016

(54) IMAGE FORMING APPARATUS AND TONER CONTAINER WITH A REPLENISHMENT HOLE AND AT LEAST ONE COLLECTION HOLE

(71) Applicant: KYOCERA DOCUMENT SOLUTIONS INC., Osaka (JP)

(72) Inventor: Takashi Morita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/142,441

(22) Filed: Dec. 27, 2013

(65) Prior Publication Data

US 2014/0186075 A1 Jul. 3, 2014

(30) Foreign Application Priority Data

Dec. 28, 2012 (JP) ..... 2012-286779

(51) Int. Cl.
*G03G 15/08* (2006.01)

(52) U.S. Cl.
CPC ..... *G03G 15/0875* (2013.01); *G03G 15/0886* (2013.01); *G03G 15/087* (2013.01); *G03G 15/0872* (2013.01); *G03G 15/0879* (2013.01); *G03G 15/0893* (2013.01)

(58) Field of Classification Search
CPC ..... G03G 15/0877; G03G 15/0879; G03G 15/087; G03G 15/0872; G03G 15/0875; G03G 15/0893
See application file for complete search history.

(56) References Cited

U.S. PATENT DOCUMENTS 5,557,382 A * 9/1996 Tatsumi et al. ..... 399/262
5,600,411 A * 2/1997 Hart ..... 399/98

FOREIGN PATENT DOCUMENTS

JP 2008-083164 A 4/2008
JP 2008-310105 A 12/2008

OTHER PUBLICATIONS

An Office Action; "Notice of Reasons for Rejection," issued by the Japanese Patent Office on Feb. 10, 2015, which corresponds to Japanese Patent Application No. 2012-286779 and is related to U.S. Appl. No. 14/142,441.

* cited by examiner

*Primary Examiner* — Joseph S Wong
(74) *Attorney, Agent, or Firm* — Studebaker & Brackett PC

(57) ABSTRACT

A toner container includes a housing and a shutter. The housing includes a toner accommodating chamber. A communication hole is formed in the housing. The communication hole communicates an interior with an exterior of the toner accommodating chamber. The communication hole also includes a replenishment hole, through which toner is supplied to the toner accommodating chamber, and a first collection hole. The shutter is configured to slide between an opening position and a closing position of the communication hole to open/close the communication hole. The shutter moves in a closing direction from the opening position to the closing position to close the replenishment hole and the first collection hole in this order.

12 Claims, 9 Drawing Sheets

IMAGE FORMING APPARATUS AND TONER CONTAINER WITH A REPLENISHMENT HOLE AND AT LEAST ONE COLLECTION HOLE

INCORPORATION BY REFERENCE

The present application claims priority under 35 U.S.C. §119 to Japanese Patent Application No. 2012-286779, filed Dec. 28, 2012. The contents of this application are incorporated herein by reference in their entirety.

BACKGROUND

The present disclosure relates to toner containers and image forming apparatuses including a toner container.

There are known image forming apparatuses, such as copiers, printers, scanners, facsimile machines, etc., for example. An image forming apparatus includes a development device to which a toner cartridge is fitted for supply of toner as a developer from the toner cartridge to the development device. In such the image forming apparatus, upon toner depletion, the toner cartridge must be exchanged. In association therewith, a shatter to close a replenishment hole is provided at the development device so as to prevent toner from scattering from the replenishment hole of the development device in exchanging the toner cartridges.

Some image forming apparatuses include a sliding shutter provided at the replenishment hole of the development device. When the toner cartridge is fitted to the development device, the sliding shutter slides to an open position to open the replenishment hole. When the toner cartridge is taken out from the development device, the sliding shutter returns to a closing position to close the replenishment hole.

SUMMARY

A toner container according to the present disclosure includes a housing and a shutter. The housing includes a toner accommodating chamber. A communication hole is formed in the housing. The communication hole communicates an interior with an exterior of the toner accommodating chamber. The communication hole also includes a replenishment hole, through which toner is supplied to the toner accommodating chamber, and a first collection hole. The shutter is configured to slide between an opening position and a closing position of the communication hole to open/close the communication hole. The shutter moves in a closing direction from the opening position to the closing position to close the replenishment hole and the first collection hole in this order.

An image forming apparatus according to the present disclosure includes the above toner container and a toner supply unit configured to supply the toner to the toner container through the replenishment hole.

DETAILED DESCRIPTION

With reference to the accompanying drawings, description will be made below about a toner container 10 and an image forming apparatus 100 including the toner container 10 according to first to sixth embodiments of the present disclosure. However, the present disclosure is not limited to the following first to sixth embodiments. Further, the subject matter described in the first to sixth embodiments can be combined in an appropriate manner.

First Embodiment

[Basic Configuration of Image Forming Apparatus 100]

Figure 1:
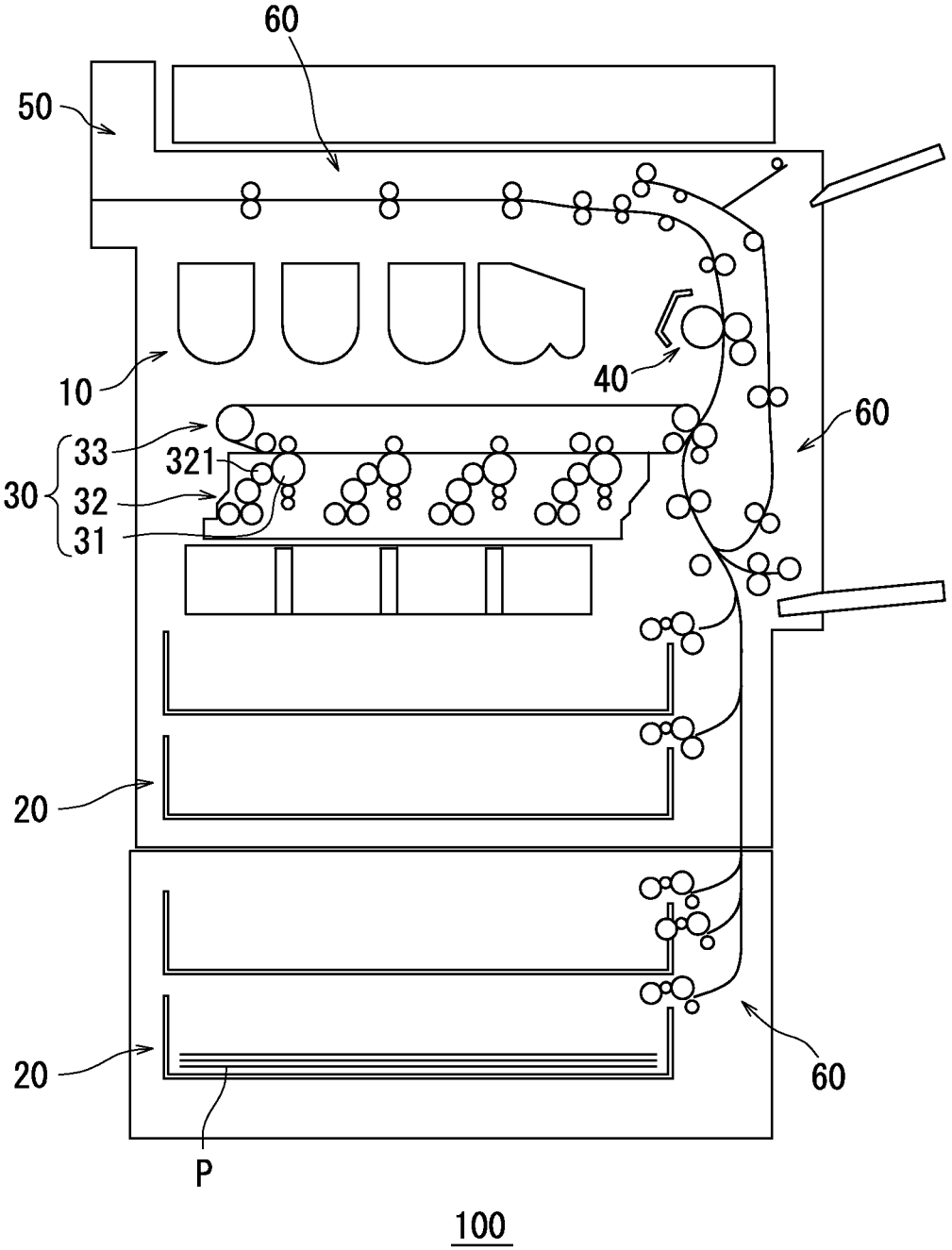
FIG. 1 is a schematic illustration showing an image forming apparatus according to the first embodiment of the present disclosure.

FIG. 1 is a schematic illustration showing an image forming apparatus 100 according to the first embodiment of the present disclosure. The image forming apparatus 100 is applicable to any of copiers, printers, facsimile machine, and multifunction peripherals having functions of them, for example. The image forming apparatus 100 in the following description is a copier. However, the present disclosure is not limited to the image forming apparatus 100 (copier) shown in FIG. 1. The image forming apparatus 100 includes a toner container 10, a paper feed cassette 20, an image forming section 30, a fixing device 40, a paper ejecting section 50, a paper conveyance section 60, and an image reading device (not shown).

The paper feed cassette 20 accommodates paper P for print. In copying, the paper conveyance section 60 conveys the paper P so that the paper P in the paper feed cassette 20 is ejected from the paper ejecting section 50 via the image forming section 30 and the fixing device 40.

The image forming section 30 forms a toner image on paper P. The image forming section 30 includes a photoreceptor 31, a development device 32, and a transfer device 33.

On the photoreceptor 31, an electrostatic latent image is formed by a laser based on electric signals of a document image generated in the image reading device. The development device 32 includes a development roller 321. The development roller 321 supplies toner to the photoreceptor 31. Thus, the electrostatic latent image is developed, thereby forming a toner image on the photoreceptor 31. The toner is supplied from the toner container 10 to the development device 32. The transfer device 33 transfers the toner image formed on the photoreceptor 31 to paper P.

The fixing device 40 applies heat and pressure to the paper P to fuse the non-fixed toner image formed in the image forming section 30. Thus, the toner image is fixed to the paper P.

[Configuration of Toner Container 10]

Figure 2:
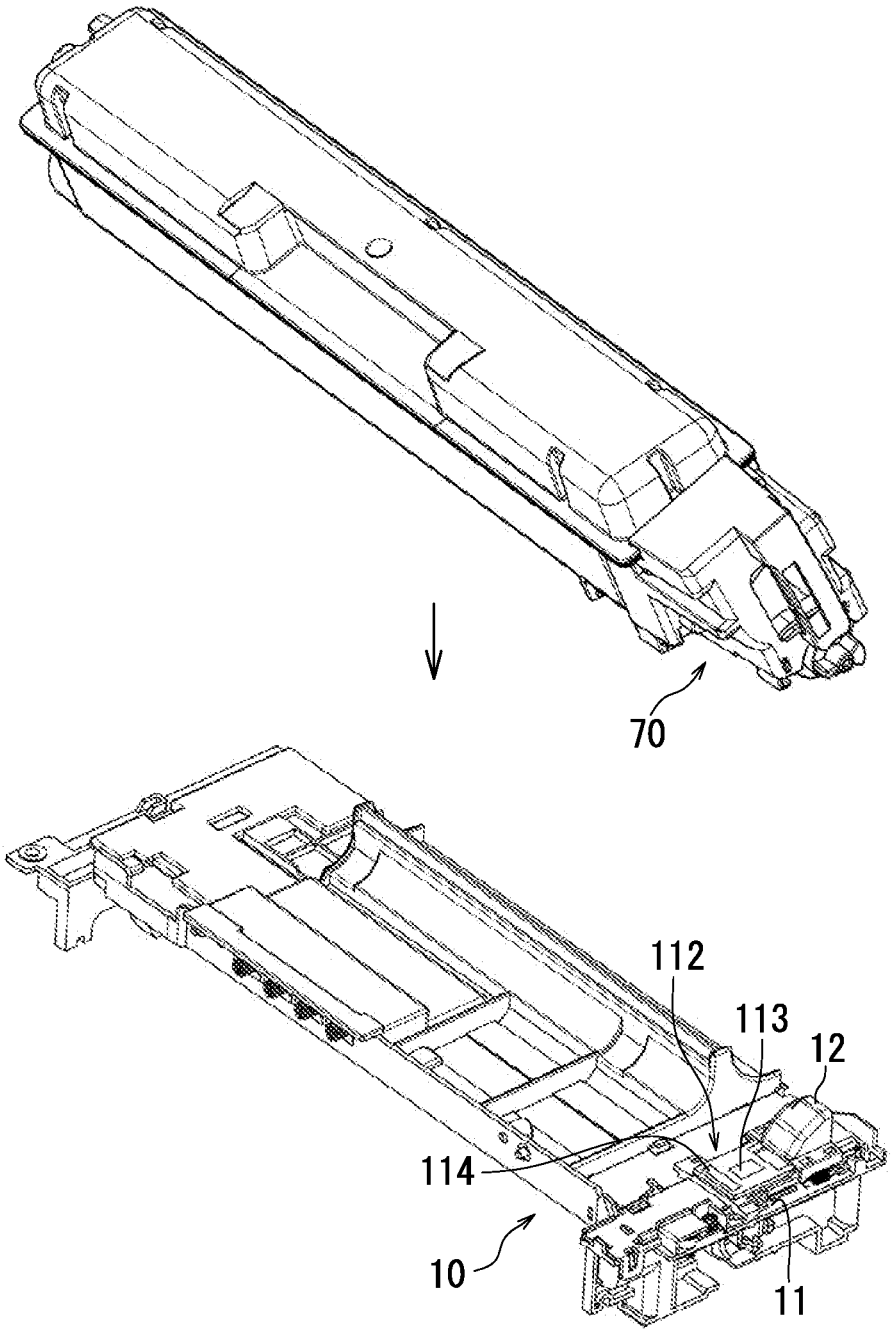
FIG. 2 is a partial perspective view schematically showing a toner container according to the first embodiment of the present disclosure.
Figure 3A:
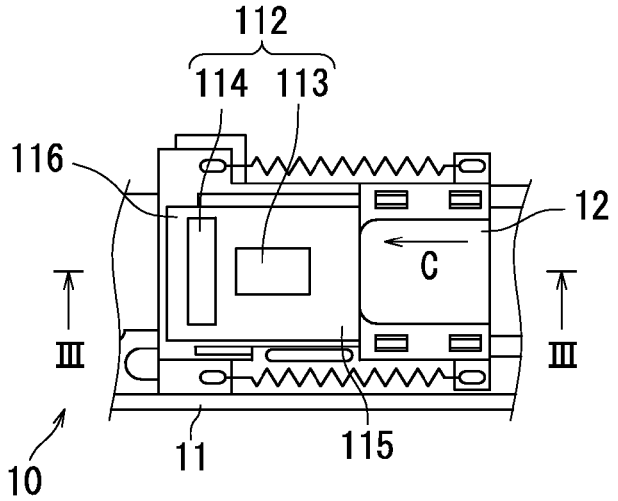
FIG. 3A is a partially enlarged top view schematically showing the toner container according to the first embodiment of the present disclosure.
Figure 3B:
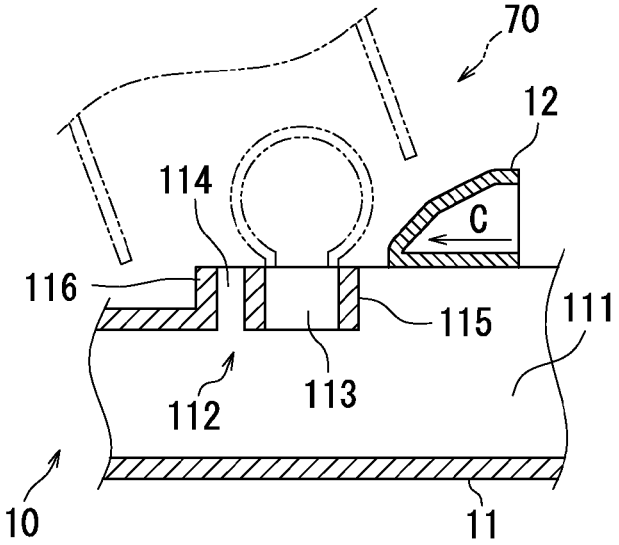
FIGS. 3B and 3C are partially enlarged front sectional view schematically showing the toner container according to the first embodiment of the present disclosure.
Figure 3C:
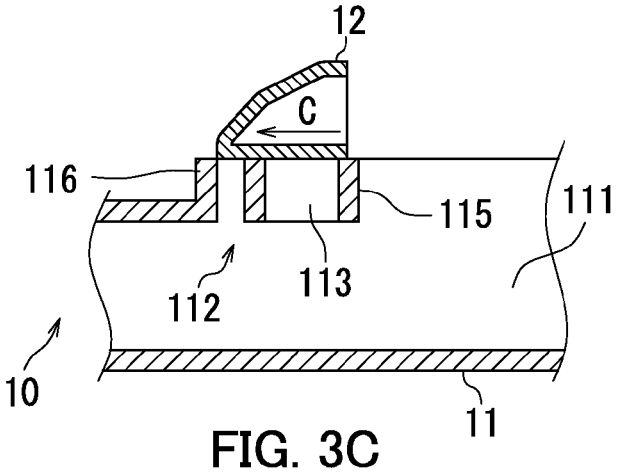

The toner container 10 according to the first embodiment of the present disclosure will be described below with reference to FIGS. 2 and 3A-3C. FIG. 2 is a partial perspective view schematically showing a toner supply unit 70 and the toner container 10 according to the first embodiment of the present disclosure. As shown in FIG. 1, the image forming apparatus 100 includes a plurality of toner containers 10 arranged side by side. FIG. 2 shows one of the plurality of toner containers 10. It is noted that the toner supply unit 70 is mounted on each of the plurality of toner container 10. However, the present disclosure is applicable to an image forming apparatus including a single toner container 10 and a single toner supply unit 70. FIG. 3A is a partially enlarged top view schematically showing one of the toner containers 10 according to the first embodiment of the present disclosure. FIGS. 3B and 3C are partially enlarged front cross sectional view schematically showing the toner container 10 taken along the line III-III in FIG. 3A.

The toner container 10 receives toner supply from the toner supply unit 70 mounted to the toner container 10. The toner supply unit 70 is a toner cartridge, for example. The toner container 10 is a toner replenishment device, for example. The toner replenishment device receives toner supply from the toner cartridge and supplies the toner to the development device 32. The toner replenishment device may be called an intermediate hopper also. Further, the toner container 10 may be part of the development device 32. The development device 32 includes a development mechanism (developing roller etc.) and receives toner supply from the toner cartridge or the toner replenishment device. The toner container 10 includes a housing 11 and a shutter 12.

The housing 11 includes a toner accommodating chamber 111. The toner accommodating chamber 111 accommodates toner supplied from the toner supply unit 70. Further, a communication hole 112 is formed in the upper part of the housing 11. Through the communication hole 112, the toner accommodating chamber 111 communicates with the exterior of the toner accommodating chamber 111. The communication hole 112 includes a replenishment hole 113 and a first collection hole 114. In the first embodiment, the housing 11 includes a first wall 115 and a second wall 116. The first wall 115 defines the replenishment hole 113. The first collection hole 114 is formed between the first wall 115 and the second wall 116. The toner ejected from the toner supply unit 70 is injected to the toner accommodating chamber 111 through the replenishment hole 113.

The shutter 12 is slidably arranged on the outer peripheral surface of the housing 11. The shutter 12 slides between a closing position and an opening position of the communication hole 112. Preferably, the shutter 12 slides in a manner that the lower surface of the shutter 12 on the side of the toner accommodating chamber 111 slides on the outer end surface of the first wall 115 and the outer end surface of the second wall 116, which are located opposite to the side of the toner accommodating chamber 111. When the shutter 12 is located at the closing position, the shutter 12 overlies the communication hole 112 to close the communication hole 112. When the shutter 12 is located at the opening position, the shutter 12 is separated from the communication hole 112 to open the communication hole 112. In the first embodiment, the replenishment hole 113 and the first collection hole 114 are formed side by side in this order in a closing direction C from the opening position toward the closing position.

As shown in FIG. 3B, in order to supply the toner to the toner container 10, the shutter 12 slides from the closing position to the opening position to open the communication hole 112. The toner ejected from the toner supply unit 70 is injected into the toner accommodating chamber 111 through the replenishment hole 113. By contrast, in order to exchange the toner supply unit 70, the shutter 12 slides from the opening position to the closing position to close the communication hole 112, as shown in FIG. 3C. Thus, the toner is prevented from scattering outward.

It is noted that it is preferable that the toner container 10 provided with the shutter 12 and the shutter 12 are configured such that the shutter 12 slides to the opening position accompanied by fitting of the toner supply unit 70 and to the closing position accompanied by removal of the toner supply unit 70.

Figure 4A:
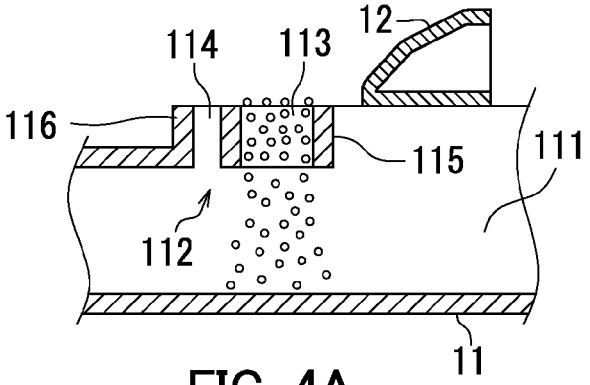
FIGS. 4A-4D are schematic illustrations showing a closing operation of a shutter at the toner container according to the first embodiment of the present disclosure.
Figure 4B:
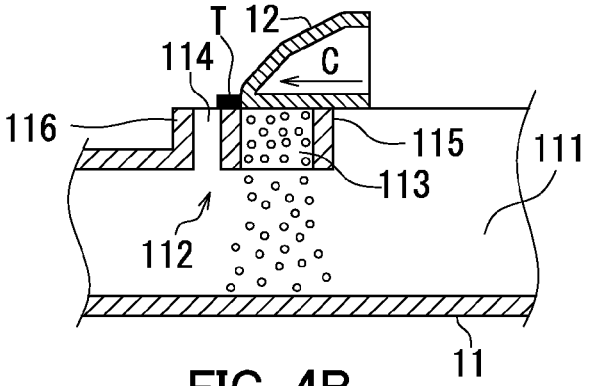
Figure 4C:
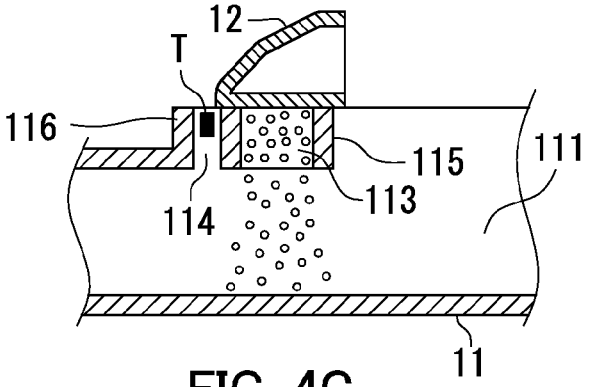
Figure 4D:
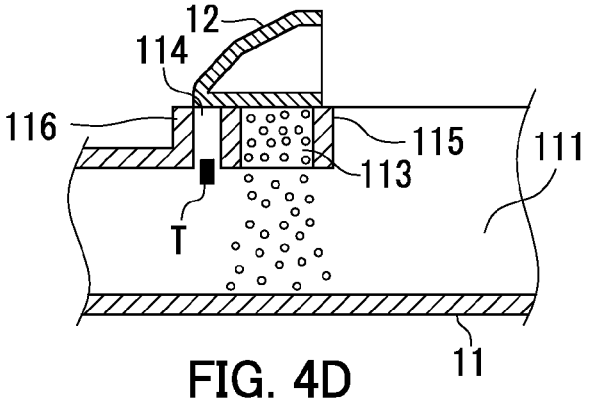

A closing operation of the shutter 12 will be described below with reference to FIGS. 4A-4D. The closing operation of the shutter 12 is performed in removal of the toner supply unit 70 (not shown in FIG. 4). FIGS. 4A-4D are schematic illustrations showing the closing operation of the shutter 12 in the toner container 10 according to the first embodiment. Specifically, FIG. 4A shows a state in which the shutter 12 is at the opening position. FIGS. 4B and 4C show states in which the shutter 12 is in the course of moving to the closing position. FIG. 4D shows a state in which the shutter 12 is at the closing position.

In the first embodiment, the toner ejected from the toner supply unit 70 is injected into the toner accommodating chamber 111 through the replenishment hole 113. Accordingly, as shown in FIG. 4A, the toner may adhere to or be accumulated in the vicinity of the inlet of the replenishment hole 113 in the housing 11 immediately after the toner supply unit 70 is removed.

As shown in FIG. 4B, when the shutter 12 slides from the opening position to the closing position, the toner adhering to or accumulated in the vicinity of the inlet of the replenishment hole 113 is scraped together by the tip end of the shutter 12 passing over the replenishment hole 113 and is conveyed in the closing direction C. Hereinafter, the toner scraped together by the tip end of the shutter 12 and conveyed in the closing direction C may be referred to as a toner accumulation (T). As shown in FIG. 4C, when the toner accumulation (T) reaches the first collection hole 114, the toner accumulation (T) falls into the first collection hole 114 and is injected into the toner accommodating chamber 111 through the first collection hole 114.

Thereafter, as shown in FIG. 4D, the shutter 12 reaches the closing position to close the replenishment hole 113 and the first collection hole 114.

Thus, as described with reference to FIGS. 2, 3A-3C, and 4A-4D, the first collection hole 114 is formed in the housing 11 of the toner container 10 according to the first embodiment. The first collection hole 114 is formed downstream of the replenishment hole 113 in the closing direction C. With the first collection hole 114, the toner accumulation T conveyed when the shutter 12 slides to the closing position can be collected. Accordingly, contamination, which is due to the toner accumulation T falling outside the communication hole 112, can be prevented. Further, collection of the toner accumulation T can achieve effective utilization of the toner with no vain.

It is noted that a sealant to prevent the toner from scattering may be provided at at least one of the outer end of the first wall 115 on the side opposite to the toner accommodating chamber 111 and the outer end of the second wall 116 on the side opposite to the toner accommodating chamber 111.

Further, where the sealant is provided at at least one of the outer end of the first wall 115 and the outer end of the second wall 116, it is preferable that the lower surface of the shutter 12 on the side of the toner accommodating chamber 111 slides on the surface of the sealant on the side opposite to the toner accommodating chamber 111.

Furthermore, in order to supply the toner supplied from the toner supply unit 70 to development device 32, the toner container 10 may include at least one of a conveyance mechanism to convey the toner to the development device 32 while stirring it and a sensor to measure a residual amount of the toner.

Second Embodiment

Figure 5:
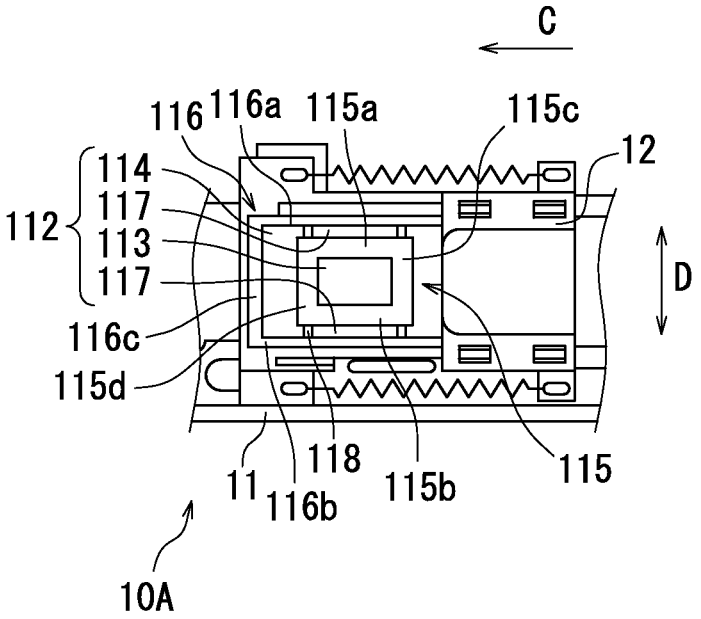
FIG. 5 is a partially enlarged top view schematically showing a toner container according to the second embodiment of the present disclosure.

FIG. 5 is a partially enlarged tope view schematically showing a toner container 10A according to the second embodiment of the present disclosure. The basic configuration of an image forming apparatus according to the second embodiment is the same as that of the image forming apparatus 100 of the above described first embodiment. Therefore, the description thereof is omitted. As shown in FIG. 5, the toner container 10A of the second embodiment has a configuration similar to that of the toner container 10 of the above described first embodiment except that a communication hole 112 in a housing 11 includes at least one second collection hole 117 and that the housing 11 includes a joint 118 that joins a first wall 115 and a second wall 116. Therefore, description of duplicate parts of the toner container 10A of the second embodiment and the toner container 10 of the first embodiment is omitted.

The first wall 115 in the second embodiment has a hollow tubular shape and is surrounded by the second wall 116. The first wall 115 is made up of four wall portions 115*a*, 115*b*, 115*c*, and 115*d*. Of the wall portions 115*a*, 115*b*, 115*c*, and 115*d*, two side wall portions 115*a* and 115*b* each extend in the closing direction C from the opening position to the closing position of the communication hole 112. A front wall portion 115*c* and a rear wall portion 115*d* each extend in an orthogonal direction D orthogonal to the closing direction C. The four wall portions 115*a*, 115*b*, 115*c*, and 115*d* define a replenishment hole 113. Further, the second wall 116 is made up of two side wall portions 116*a* and 116*b* extending in the closing direction C and a rear wall portion 116*c* extending in the orthogonal direction D. A first collection hole 114 is formed between the rear wall portion 115*d* of the first wall 115 and the rear wall portion 116*c* of the second wall 116.

Referring to FIG. 5, the communication hole 112 includes two second collection holes 117. The two second collection holes 117 are formed in the respective sides of the replenishment hole 113 in the orthogonal direction D. The respective two second collection holes 117 are formed between one 115*a* of the side wall portions 115*a* and 115*b* of the first wall 115 and one 116*a* of the side wall portions 116*a* and 116*b* of the second wall 116 and between the other side wall portion 115*b* of the first wall 115 and the other side wall portion 116*b* of the second wall 116. However, the communication hole 112 may include only one of the second collection holes 117. In this case, one second collection hole 117 is formed in one of the sides of the replenishment hole 113 in the orthogonal direction D.

A joint 118 joins the first wall 115 and the second wall 116. The joint 118 holds the first wall 115. For example, the joint 118 joins the first wall 115 to the second wall 116 across the first collection hole 114. Alternatively, the joint 118 may join the first wall 115 to the second wall 116 across the second collection holes 117. It is noted that the joint 118, the first wall 115, and the second wall 116 may be formed as an integral member. Alternatively, the joint 118 may be formed of a member different from the first wall 115 and the second wall 116.

Thus, the toner container 10A according to the second embodiment has been described with reference to FIG. 5. The shutter 12 of the toner container 10A conveys the toner accumulation T predominantly in the closing direction C when it slides from the opening position to the closing position. However, part of the toner accumulation T may flow in the orthogonal direction D along the tip end of the shutter 12. Such the toner accumulation T falls into the second collection holes 117 formed on the respective sides of the replenishment hole 113 in the orthogonal direction D. The toner accumulation T falling in the second collection hole 117 is injected into the toner accommodating chamber 111 through the second collection holes 117. Accordingly, contamination caused due to the toner flowing in the orthogonal direction D and scattering outside the communication hole 112, can be prevented.

It is noted that the toner accumulation T is predominantly conveyed in the closing direction C in the second embodiment. Accordingly, it is preferable that the joint 118 joins the first wall 115 and the second wall 116 across the second collection holes 117 so that the joint 118 will not block the toner accumulation T falling in the first collection hole 114.

Further, in the second embodiment, the first wall 115 is held by the joint 118 across the first collection hole 114 or the second collection holes 117. However, the present disclosure is not limited to this. The first wall 115 may be held by another member formed in the toner accommodating chamber 111, for example.

Third Embodiment

Figure 6:
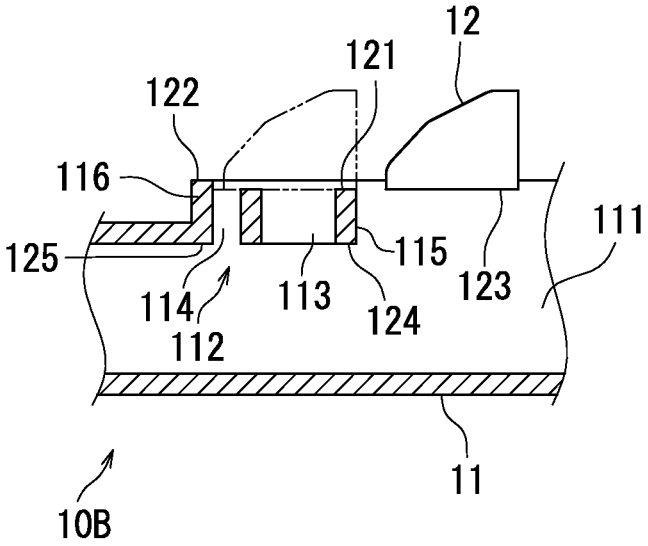
FIG. 6 is a partially enlarged front cross sectional view schematically showing a toner container according to the third embodiment of the present disclosure.

FIG. 6 is a partially enlarged front cross sectional view schematically showing a toner container 10B according to the third embodiment of the present disclosure. The basic configuration of an image forming apparatus according to the third embodiment is the same as that of the image forming apparatus 100 in the above described first embodiment. Therefore, the description thereof is omitted. As shown in FIG. 6, a toner container 10B according to the third embodiment has the same configuration as the toner container 10 or 10A of the above described first or second embodiment, except that the height level of the outer end portion of a first wall 115 of a housing 11 is different from the that of the outer end portion of a second wall 116 of the housing 11. Therefore, description of duplicate parts of the toner container 10B of the third embodiment and the toner container 10 or 10A of the first or second embodiment is omitted.

The first wall 115 in the third embodiment includes a first outer end portion 121 extending outward in the housing 11 and a first inner end portion 124 extending inward in the housing 11. Further, the second wall 116 includes a second outer end portion 122 extending outward in the housing 11 and a second inner end portion 125 extending inward in the housing 11. The second outer end portion 122 is located higher than the first outer end portion 121. The shutter 12 includes a lower end portion 123. When the shutter 12 slides from the opening position to the closing position, the second wall 116 surrounds the lower end portion 123.

Thus, the toner container 10B according to the third embodiment has been described with reference to FIG. 6. In the third embodiment, the second outer end portion 122 is located higher than the first outer end portion 121. Accordingly, the toner accumulation T can be prevented from climbing over the second outer end portion 122 and scattering outside the communication hole 112. Thus, contamination caused due to toner scattering can be effectively prevented.

Fourth Embodiment

Figure 7:
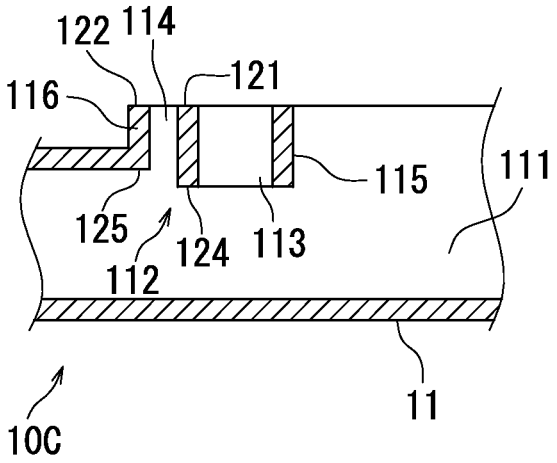
FIG. 7 is a partially enlarged front cross sectional view schematically showing a toner container according to the fourth embodiment of the present disclosure.

FIG. 7 is a partially enlarged front cross sectional view schematically showing a toner container 10C according to the fourth embodiment of the present disclosure. The basic configuration of an image forming apparatus according to the fourth embodiment is the same as that of the image forming apparatus 100 in the above described first embodiment. Therefore, the description thereof is omitted. As shown in FIG. 7, a toner container 10C according to the fourth embodiment has the same configuration as the toner container 10A of the above described second embodiment, except that the height of the inner end portion of a first wall 115 of a housing 11 is different from that of the inner end portion of a second wall 116 of the housing 11. Therefore, description of duplicate parts of the toner container 10C of the fourth embodiment and the toner container 10A of the second embodiment is omitted.

The first wall 115 in the fourth embodiment includes a first outer end portion 121 extending outward in the housing 11 and a first inner end portion 124 extending inward in the housing 11. Further, the second wall 116 includes a second outer end portion 122 extending outward in the housing 11 and a second inner end portion 125 extending inward in the housing 11. The first inner end portion 124 is located lower than the second inner end portion 125.

Thus, the toner container 10C according to the fourth embodiment has been described with reference to FIG. 7. The toner is injected into the toner accommodating chamber 111 through the replenishment hole 113 when the toner supply unit 70 supplies the toner to the toner container 10C. In the fourth embodiment, the first inner end portion 124 is located lower than the second inner end portion 125. Accordingly, the toner injected in the toner accommodating chamber 111 can be prevented from flowing backward to the toner supply unit 70 through the first collection hole 114 and the second collection holes 117.

It is noted that the first outer end portion 121 is leveled to the second outer end portion 122 in the toner container 10C shown in FIG. 7. However, the present disclosure is not limited to this. Similarly to the above described third embodiment, the second outer end portion 122 may be located higher than the first outer end portion 121. Further, similarly to the first embodiment, the communication hole 112 may include only the replenishment hole 113 and the first collection hole 114.

Fifth Embodiment

Figure 8:
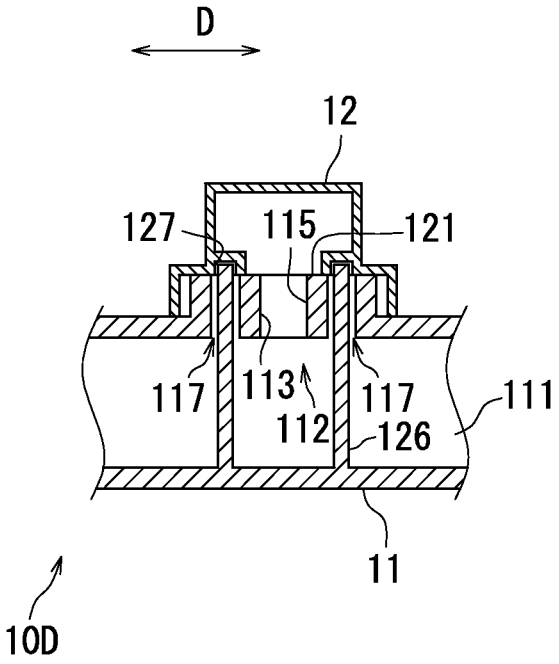
FIG. 8 is a partially enlarged side cross sectional view schematically showing a toner container according to the fifth embodiment of the present disclosure.

FIG. 8 is a partially enlarged side cross sectional view schematically showing a toner container 10D according to the fifth embodiment of the present disclosure. The basic configuration of an image forming apparatus according to the fifth embodiment is the same as that of the image forming apparatus 100 in the above described first embodiment. Therefore, the description thereof is omitted. As shown in FIG. 8, a toner container 10D according to the fifth embodiment has the same configuration as the toner container 10A of the above described second embodiment, except that a housing 11 includes an insulating wall 126 to prevent tonner scattering. Therefore, description of duplicate parts of the toner container 10D of the fifth embodiment and the toner container 10A of the second embodiment is omitted.

The housing 11 in the fifth embodiment includes insulating walls 126 extending from the interior of the toner accommodating chamber 111. The respective insulating walls 126 are formed to extend to the outside of the housing 11 through respective second collection holes 117. Each insulating wall 126 has a free end portion located higher than a first outer end portion 121 of a first wall 115.

It is noted that the insulating wall 126 is required only to extend from the interior of the housing 11. From which part of the housing 11 the insulating wall 126 extends is not limited. Further, in FIG. 8, the insulating walls 126 and the housing 11 are formed as an integral member. However, the insulating walls 126 and the housing 11 may be different members.

Recesses 127 are formed in a lower end portion 123 of the shutter 12. When the shutter 12 slides between the opening position and the closing position, the free end portions of the insulating walls 126 pass in the recesses 127.

Thus, the toner container 10D according to the fifth embodiment has been described with reference to FIG. 8. In the toner container 10D, the free end portions of the insulating walls 126 are located higher than the first outer end portion 121. Accordingly, toner accumulation T can be prevented from climbing over the insulating wall 126 in the orthogonal direction D and scattering outside the communication hole 112. Thus, contamination caused due to toner scattering can be effectively prevented. Further, in the toner container 10D of the fifth embodiment, the free end portions of the insulating walls 126 of the housing 11 can define the sliding direction of the shutter 12. Accordingly, the toner container 10D of the fifth embodiment can guide the sliding of the shutter 12.

It is noted that in the toner container 10D shown in FIG. 8, the outer end portion of the first wall 115 is leveled to the outer end portion of the second wall 116. However, the present disclosure is not limited to this. Similarly to the above described third embodiment, the outer end portion of the second wall 116 may be located higher than the outer end portion of the first wall 115. Further, in the toner container 10D shown in FIG. 8, the inner end portion of the first wall 115 is leveled to the inner end portion of the second wall 116. However, the present disclosure is not limited to this.

Similarly to the above described fourth embodiment, the inner end portion of the first wall 115 may be located lower than the inner end portion of the second wall 116.

Sixth Embodiment

Figure 9:
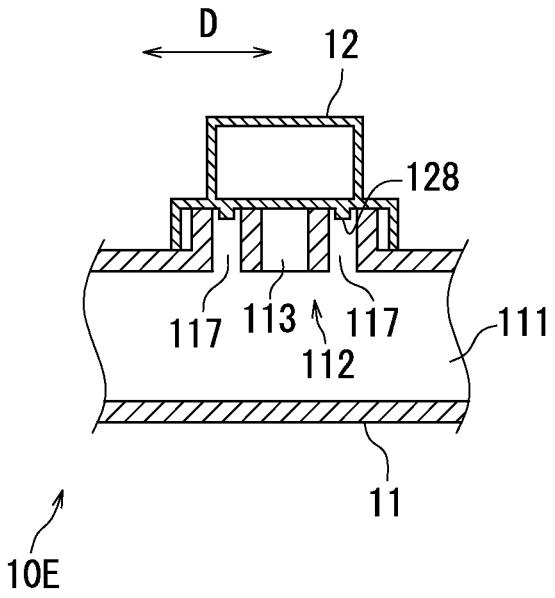
FIG. 9 is a partially enlarged side cross sectional view schematically showing a toner container according to the sixth embodiment of the present disclosure.

The housing 11 in the fifth embodiment described with reference to FIG. 8 includes the insulating walls 126 to prevent toner scattering. However, the present disclosure is not limited to this. FIG. 9 is a partially enlarged side cross sectional view schematically showing a toner container 10E according to the sixth embodiment of the present disclosure. The basic configuration of an image forming apparatus according to the sixth embodiment is the same as that in the image forming apparatus 100 in the above described first embodiment. Therefore, the description thereof is omitted. As shown in FIG. 9, a toner container 10E according to the sixth embodiment has the same configuration as the toner container 10A of the above described second embodiment, except that a shutter 12 of the toner container 10E of the sixth embodiment includes an insulating wall 128. Therefore, description of duplicate parts of the toner container 10E of the sixth embodiment and the toner container 10A of the second embodiment is omitted.

The shutter 12 includes insulating walls 128 extending toward the interior of an accommodating chamber 111. The insulating walls 128 may be provided at a lower end portion 123 of the shutter 12. When the shutter 12 slides between the opening position and the closing position, the insulating walls 128 pass in the second collection holes 117.

Thus, as has been described with reference to FIG. 9, in the toner container 10E, the insulating walls 128 pass over the second collection holes 117 when the shutter 12 slides. Accordingly, toner accumulation T can be prevented from climbing over the insulating wall 128 in the orthogonal direction D and scattering outside the communication hole 112. Thus, contamination caused due to toner scattering can be effectively prevented. Further, the insulating walls 128 can define the sliding direction of the shutter 12. Accordingly, the toner container 10E of the sixth embodiment can guide the sliding of the shutter 12.

It is noted that in the toner container 10E shown in FIG. 9, an outer end portion of a first wall 115 is leveled to an outer end portion of a second wall 116. However, the present disclosure is not limited to this. Similarly to the above described third embodiment, the outer end portion of the second wall 116 may be located higher than the outer end portion of the first wall 115. Further, in the toner container 10E shown in FIG. 9, an inner end portion of the first wall 115 is leveled to an inner end portion of the second wall 116. However, the present disclosure is not limited to this. Similarly to the above described fourth embodiment, the inner end portion of the first wall 115 may be located lower than the inner end portion of the second wall 116.

What is claimed is:

1. A toner container for receiving toner supply from a toner supply unit, comprising:

a housing including a toner accommodating chamber that accommodates toner supplied from the toner supply unit, a communication hole being formed in the housing, the communication hole communicating an interior with an exterior of the toner accommodating chamber and including a replenishment hole, through which toner ejected from the toner supply unit is supplied to the toner accommodating chamber, and a first collection hole; and a shutter configured to slide between an opening position and a closing position of the communication hole to open and close the communication hole, the shutter moving in a closing direction from the opening position to the closing position to close the replenishment hole and the first collection hole in order thereof in a manner to overlie the replenishment hole and the first collection hole in order thereof, wherein when the shutter is located at the opening position, the communication hole is opened, and when the shutter is located at the closing position, the shutter overlies the communication hole to close the communication hole.

2. A toner container according to claim 1, wherein the communication hole further includes at least one second collection hole, the replenishment hole and the at least one second collection hole are arranged side by side in an orthogonal direction orthogonal to the closing direction, and the shutter overlies the second collection hole when overlying the replenishment hole.

3. A toner container according to claim 1, wherein the communication hole further includes second communication holes formed on respective sides of the replenishment hole in an orthogonal direction orthogonal to the closing direction, and the shutter overlies the second collection holes when overlying the replenishment hole.

4. A toner container according to claim 2, wherein the housing includes:

a first wall which defines the replenishment hole;

a second wall; and a joint configured to join the first wall and the second wall, and the first collection hole and the at least one second collection hole are formed between the first wall and the second wall.

5. A toner container according to claim 4, wherein the joint is arranged across the at least one second collection hole.

6. A toner container according to claim 4, wherein the first wall includes a first outer end portion extending outward in the housing, the second wall includes a second outer end portion extending outward in the housing, the second outer end portion is located higher than the first outer end portion, the shutter includes a lower end portion facing an interior of the housing, and the lower end portion is surrounded by the second wall when the shutter is at the closing position.

7. A toner container according to claim 4, wherein the first wall includes a first inner end portion extending inward in the housing, the second wall includes a second inner end portion extending inward in the housing, and the first inner end portion is located lower than the second inner end portion.

8. A toner container according to claim 2, wherein the housing includes an insulating wall extending outside the housing from the interior of the toner accommodating chamber through the at least one second collection hole.

9. A toner container according to claim 2, wherein the shutter includes an insulating wall extending in the at least one second collection hole toward the interior of the toner accommodating chamber.

10. An image forming apparatus comprising:

a toner container according to claim 1; and a toner supply unit configured to supply toner to the toner container through the replenishment hole.

11. A toner container according to claim 1, wherein the housing includes a first wall and a second wall, the first wall defining the replenishment hole, the shutter has a tip end, the first collection hole is formed between the first wall and the second wall, and when the shutter moves in the closing direction, the tip end of the shutter causes toner adhering to an upper end surface of the first wall to fall into the tonner accommodating chamber through the first collection hole.

12. A toner container according to claim 1, wherein the communication hole is located in an upper part of the housing.

* * * * *